United States Patent [19]

Kaplan et al.

[11] 4,158,995

[45] Jun. 26, 1979

[54] COMPACTING TOOL FOR WASTE MATERIAL

[75] Inventors: Leonard J. Kaplan; Bernard Gutterman, both of Greensboro, N.C.

[73] Assignee: Kay Chemical Company, Greensboro, N.C.

[21] Appl. No.: 802,200

[22] Filed: May 31, 1977

[51] Int. Cl.[2] ..... B30B 15/06

[52] U.S. Cl. ..... 100/295; 100/240

[58] Field of Search ..... D7/99, 101, 103; 241/169.2, 168, 169; 81/1 RT; 100/295, 240, DIG. 14, 229 A, 245

[56] References Cited

U.S. PATENT DOCUMENTS

| | | | |
|---|---|---|---|
| D. 206,926 | 2/1967 | Lurski | D7/101 |
| 3,285,505 | 11/1966 | Katz | 100/DIG. 14 |
| 3,779,157 | 12/1973 | Ross | 100/240 |
| 3,797,382 | 3/1974 | Muzzi | 100/295 |

*Primary Examiner*—Billy J. Wilhite

[57] ABSTRACT

An elongated post member having a handle at the upper end and an enlarged compacting head at the lower end thereof provides a portable tool for compacting paper waste in waste cans of the type generally having a plastic liner therein and normally receiving predominantly paper waste such as cups, bags, napkins, straws, wrappers, light cardboard boxes and the like. The compacting head is in the shape of a flat, generally open, framework formed of a smoothly joined, solid round or tubular, non-porous, metallic material with a non-porous chrome, vinyl, or smooth baked enamel finish for sanitary purposes. The compacting head is flat on the bottom and of sufficient size to make the tool self-standing when not is use. The operative area of the compacting head covers at least 20% of the cross-sectional area of the waste can with which the tool is to be used. The open framework is formed by a plurality of substantially radial arms, emanating at the center of the framework and connected at their extremities by a plurality of peripheral members. The overall weight of the tool is in the range of two to five pounds.

2 Claims, 2 Drawing Figures

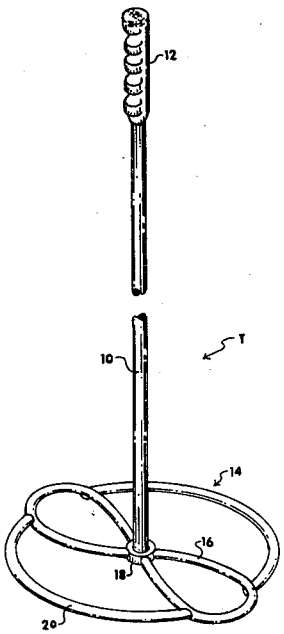

COMPACTING TOOL FOR WASTE MATERIAL

BACKGROUND OF THE INVENTION

During the past several years the emphasis of ecologists in keeping a clean environment coupled with the ever increasing use of disposable paper products has accented the always present, but sometimes not as troublesome, task of emptying waste cans, litter boxes and the like. For example, in the fast food industry, an average fast food store typically employs several waste cans scattered throughout the restaurant where residents may deposit their own litter upon completion of their meal. Each of such waste cans or baskets generally takes the form of a housing having an access opening which is usually covered by some type of swinging door or cover. Within the generally, but not necessarily a removable can normally, but not necessarily, having a thin film plastic liner removably deposited therein. Periodically throughout the day each of such waste cans is removed from the housing, the plastic bag removed, tied off at the top, and carried out to a collection point in the rear of the building.

It is somewhat surprising that tests have shown that such an establishment may use fifty to sixty of such plastic liners a day, while an estimated attendant two to four man-hours of employee time per day (depending on the season) are required to make so many emptyings. Often such waste cans become full and overflowing at peak times which makes it extremely inconvenient for an employee to be relieved from his normal duties to empty waste cans. However, if such is not done, the areas in which the waste cans are located become extremely unsightly with an attendant ill effect on the normally clean atmosphere of the restaurant.

Further, two or three times a day a relatively expensive serving tray will erroneously, either inadvertently or deliberately be dropped into a waste can or basket in such types of establishment. When the plastic liner is merely tied off and deposited in the collection container outside, the fact that a serving tray is in the bag rarely becomes known to the employee. The large volume to weight ratio of the bags carries over to the outside containers so that they fill more rapidly and have to be emptied more often with additional cost disadvantages. The same problems to a greater or lesser extent exist in other businesses, industries, institutions and public places, even in the home.

While compacting of the trash becomes important there are only two types of approaches to trash compacting heretofore known. One is the electro-mechanical compactor, which is a container having a mechanically powered ram that mashes and grinds up trash as it is deposited therein. The other is a waste receptacle of the type illustrated and described in U.S. Pat. No. 3,779,157 in which a compacting ram is permanently mounted for slidable operation in the cover of the waste receptacle. Both of these approaches are relatively expensive as far as initial cost is concerned.

SUMMARY OF THE PRESENT INVENTION

The present invention, however, is directed to a manual trash compacting implement which is portable, and may be used with substantially all existing waste receptacles without involving any substantial outlay of money. The implement is merely inserted into the waste can with the liner installed (where a liner is utilized) and the paper trash is tamped down four or five times. The result is that approximately half of the emptyings can be eliminated using approximately half of the number of plastic liners formerly necessary with approximately sixty percent of the man-hours.

The tamping implement is specifically designed for the use to which it is to be put. The whole member or shaft is slightly longer than the height of the cans with which the implement is to be used; the tool is of a weight in the range of two to five pounds so that while it is light enough to be easily used by an employee, it is also heavy enough to do considerable work when it is tamped lightly. The head of the tool is of such a size that it covers about twenty percent of the area of the inside of the container to limit the number of tamps required, and is also of a relatively open, framework construction. So constructed, the openings in the head are not large enough to allow normal items in the waste receptacle to pass through during the tamping operation. The open configuration also allows the employee visual communication with the inside of the container to pick out trays which may have been erroneously deposited therein. The tool is preferably formed of a non-porous, metallic material with a chrome or other non-porous, smooth finish for purposes of sanitation. The head is formed of a smoothly joined, preferably round or tubular stock providing rounded edges and a flat bottom to prevent tearing of the plastic liner as it is inserted and operated within the waste receptacle. The open framework of the head is preferably formed by a plurality of substantially radial arms, which are connected at their extremities by one or more arcuate peripheral tubular members.

The specific design of the implement has evolved after several attempts, each of which were discarded because of one or more of the above disadvantages which were not overcome. The resulting tool has nearly doubled the weight of trash contained in each trash bag. Untamped trash bags weigh approximately five pounds while tamped bags weigh in the range of ten to twelve pounds. Increase in the trash weight accordingly decreases the volume necessary to contain and store. That is to say, the weight of trash now occupies approximately half the space as formerly. Approximately five hundred bags per month and one collection container loading per week can be saved in an average size restaurant. Using collection container hauling costs ranging from five to twenty-five dollars each and bags costing approximately 6.25 cents, the savings over a year's period of time can easily amount to hundreds of dollars. Even where bags are not used, the numbers of emptyings of cans and haulings of collection containers may be reduced.

As an added benefit, the material from which the tool is made causes an unmistakable sound when striking a food serving tray which may have been accidentally dropped into the trash receptacle. Tests have shown that almost two trays per day can be reclaimed in an average operating restaurant.

As an interesting, unexpected, side result, it has always been a problem in the restaurant business that, where plastic bags are used, some of the plastic bags exhibit leaks when being removed from the cans they occupy. These "leakers" leave an unsightly trail across the floor of the restaurant as they are being transported to the collection container. Such display of garbage leak is offensive to customers and requires immediate cleaning by the restaurant staff. Since less bags are being used, less occurrences of "leakers" is obviously to be realized. However, further, it has been found by considerable sampling that "tamped" trash bags do not have the leak frequency or percentage of leaks of non-tamped bags and therefore the number of "leakers" is even further reduced. This is partially explained from the fact that when an untamped bag is lifted from the container, the trash therein is loose and generally shifts around, with the result that the plastic liner may be ruptured. While one would naturally assume that the tamping could also have caused such ruptures, the reverse has been found to be true. Apparently the fact that the plastic liner is supported within the waste container during such operation prevents as many such ruptures as might normally be expected.

The size of the compacting head has been carefully designed to minimize the number of tamps required per tamping, as well as to be large enough to make the tool self-standing on the floor. Yet the tool is not so large as to be difficult to handle or insert within the hinged cover of the housing which covers the waste receptacle when and if desired. All of the aforementioned advantages in the fast food industry in which a large volume of light paper articles are generated and disposed of, such advantages carry over, although possibly to a lesser extent in other businesses, institutions, public places, and in the home.

It is therefore an object of the present invention to provide a tool which easily and cheaply improves the waste collection system of establishments which generate a lot of paper waste, such as fast food centers.

It is another object of the present invention to provide a tool which is specifically designed to optimize tamping of paper trash, while preventing damage to receptacle liners.

Other objects and a fuller understanding of the invention will become apparent from reading the following detailed description of a preferred embodiment in conjunction with the accompanying drawings in which:

FIG. 1 is a perspective view of the compacting implement according to the present invention; and FIG. 2 is an enlarged perspective view of the head portion only of a second embodiment of the tool of the present invention.

DETAILED DESCRIPTION OF THE PREFERRED EMBODIMENT

Figure 1:
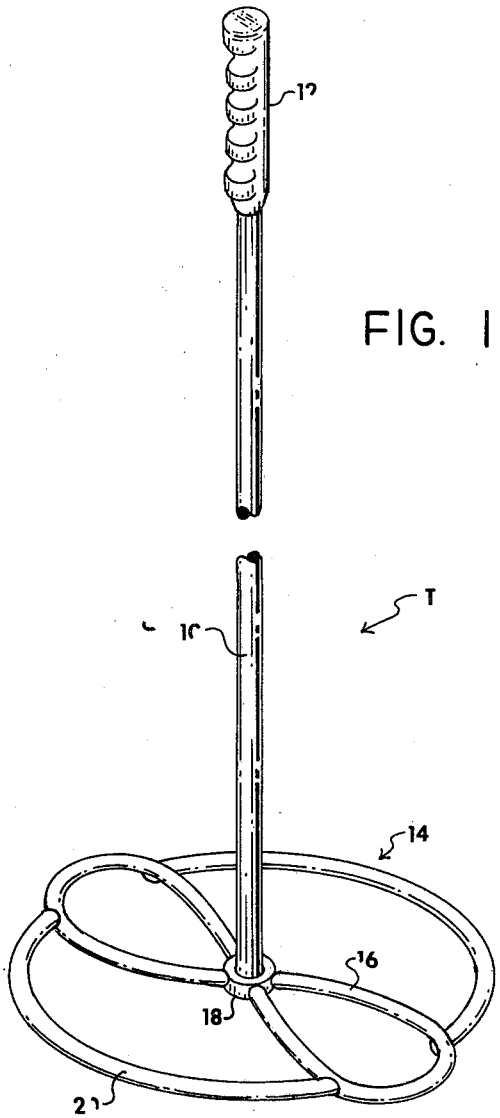

Turning now to the drawings, particularly to FIG. 1, there is illustrated the trash compacting tool T according to the present invention, which includes in general, an elongated post member 10 approximately ¾" in diameter, having a handle portion 12 at the upper end thereof, and a compacting head 14 secured either permanently or releasably to the lower end thereof. The compacting head 14 includes a generally open framework formed of smoothly joined, non-porous, preferably solid round, metallic stock having a chrome or other smooth, non-porous finish for sanitary purposes. The head 14 is of a sufficient size (major axis—10 inches, minor axis—8 inches) as to make the tool self-standing when not in use and to form an operating area of at least approximately one-fifth or twenty percent of the cross-sectional area of standard size waste collection cans with which the tool is to be used.

Preferably, the open framework is formed by a plurality of substantially radial arms 16 connected at their extremities by one or more peripheral members 20. Both the arms 16 and peripheral members 20 are of solid round or tubular stock at least ⅜" in diameter. At the intersection of the arms, a hub 18 or other connecting means between the post member 10 and head portion 14 is provided. Alternatively the arms, peripheral members, and post member may be welded together. The entire tool weights in the range of two to five pounds.

Figure 2:
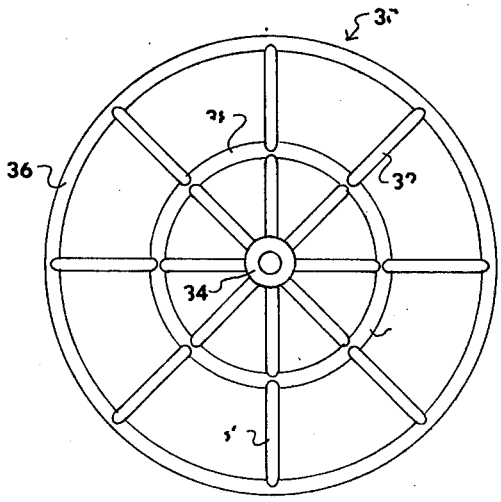

Preferably, the substantially radial arms 16 may be formed by a figure-8 configuration, with the upper portion thereof connected by arcuate members 20. In the alternate embodiment of FIG. 2 a generally circular head 30 includes a plurality of radial arms 32 formed of the same material as set forth hereinabove and having at the center thereof a connecting hub 34 for connecting the upstanding post member 10 thereof. An outer ring 36 connects the extremities of radial arms 32 while an inner ring 38 connects the mid portion thereof for spacing reasons.

The entire tool has a length of approximately thirty-seven inches for ease of handling, since conventional trash cans are approximately twenty-nine inches high, thereby providing assurance that a worker or employee's hands do not have to be inserted into the waste receptacle in order to perform the tamping operation. It may be easily seen that the length of the tool may vary, depending on the height of the receptacle with which it is to be used. The head size provides a preferable ratio of can area to tamper area of about 5 to 1. Whereas a smaller area would necessitate more tamping strokes to achieve compaction, and whereas the smaller dimension might not permit the unit to be free standing, a larger dimension would preclude the tamper's use in smaller trash receptacles or by insertion through the swinging or open entry in the waste receptacle covers.

The non-porous material from which the tool may be fabricated, cast, or molded and the smooth, non-porous finish provides an extremely sanitary tool that is easy to clean.

The head configuration, with the flat bottom and rounded edges, besides the advantages named hereinabove, will not rupture the plastic liners conventionally available in most waste receptacles, and the open nature of the head allows the user to visualize any solid articles encountered during the tamping operation. On the other hand, the head configuration is so designed as to prevent wedging of paper articles between the orifices or openings therein.

Although a preferred embodiment has been illustrated and described, and although development and testing has shown the embodiment of FIG. 1 to be the preferred embodiment, slight modifications and changes might be accomplished without departing from the scope of the invention which is set forth in the accompanying claims:

What is claimed is:

1. A tool for manually compacting paper waste in waste cans of the type normally receiving predominantly paper waste such as cups, bags, napkins, straws, wrappers, light cardboard boxes and the like, said tool comprising:

(a) an elongated post member separate from said waste can having a handle at the upper end and an enlarged compacting head attached to the lower end thereof;

(b) said compacting head:

(i) including a generally open framework with rounded edges and a flat bottom and formed of smoothly joined, tubular, non-porous round stock substantially ⅜" in diameter and having a smooth, non-porous finish for sanitation purposes;

(ii) having outer dimensions of sufficient size to make the tool self-standing when not in use and forming an operative area covering at least 20% of the cross-sectional area of conventional waste cans with which the tool is normally used;

(iii) said open framework formed by a plurality of radial arms formed in a figure-8 configuration with arcuate members joining the extremities thereof; and (c) said tool weighing in the range of two to five pounds.

2. A tool for manually compacting paper waste in waste cans of the type normally receiving predominantly paper waste such as cups, bags, napkins, straws, wrappers, light cardboard boxes and the like, said tool comprising:

(a) an elongated post member separate from said waste can having a handle at the upper end and an enlarged compacting head attached to the lower end thereof;

(b) said compacting head:

(i) including a generally open framework with rounded edges and a flat bottom and formed of smoothly joined, tubular, non-porous round stock substantially ⅜" in diameter and having a smooth, non-porous finish for sanitation purposes;

(ii) having outer dimensions of sufficient size to make the tool self-standing when not in use and forming an operative area covering at least 20% of the cross-sectional area of conventional waste cans with which the tool is normally used;

(iii) said open framework formed by a plurality of substantially radial arms equally spaced and joined at their extremities by a circular round member, and a second circular round member connecting the intermediate portions of said arms;

(c) said tool weighing in the range of two to five pounds.

* * * * *